US008142055B2

(12) United States Patent
Dorr et al.

(10) Patent No.: US 8,142,055 B2
(45) Date of Patent: Mar. 27, 2012

(54) SYSTEMS, APPARATUS, AND METHODS INVOLVING LAMPSHADE LEVELING

(76) Inventors: Brian L. Dorr, Alpharetta, GA (US); Thomas Koch, Gulf Breeze, FL (US)

( * ) Notice: Subject to any disclaimer, the term of this patent is extended or adjusted under 35 U.S.C. 154(b) by 74 days.

(21) Appl. No.: 12/138,716

(22) Filed: Jun. 13, 2008

(65) Prior Publication Data

US 2008/0310170 A1 Dec. 18, 2008

Related U.S. Application Data

(60) Provisional application No. 60/934,400, filed on Jun. 13, 2007.

(51) Int. Cl.
*F21V 17/02* (2006.01)

(52) U.S. Cl. ..... 362/322; 362/351; 362/410; 362/417

(58) Field of Classification Search ..... 362/277, 362/280, 282, 319, 322–324, 351, 356, 417, 362/452, 410, 412
See application file for complete search history.

(56) References Cited

U.S. PATENT DOCUMENTS

| | | | | |
|---|---|---|---|---|
| 2,805,329 | A | 9/1957 | Golden | |
| 2,808,503 | A * | 10/1957 | Ball | 362/452 |
| 3,016,455 | A * | 1/1962 | Goldfine | 362/452 |
| 3,281,590 | A | 10/1966 | Truax et al. | |
| 3,309,515 | A | 3/1967 | Fanshier | |
| 7,008,083 | B2 | 3/2006 | Leddusire | |
| 7,410,277 | B1 * | 8/2008 | Leddusire | 362/417 |

* cited by examiner

*Primary Examiner* — Thomas Sember
(74) *Attorney, Agent, or Firm* — Blake I. Dorr

(57) ABSTRACT

A system for leveling a lampshade comprising, a pivot member operative to engage a post of a lamp harp and support a spyder portion of a lampshade, and a retaining member operative to engage the post and induce a force on the spyder portion.

16 Claims, 4 Drawing Sheets

SYSTEMS, APPARATUS, AND METHODS INVOLVING LAMPSHADE LEVELING

CROSS-REFERENCE TO RELATED APPLICATIONS

This application claims the benefit of U.S. Provisional Application No. 60/934,400, filed Jun. 13, 2007.

BACKGROUND OF THE INVENTION

1. Field of the Invention

The invention relates to lamps and methods and systems involving leveling lampshades.

2. Description of Background

Lampshades are commonly used on lamps and lighting fixtures for decoration and for directing light in a particular direction. Often lampshades are attached to a lamp with a fastener. The components of lamps are often made of metal that can be bent out of shape if subjected to a force resulting from a fall or from a blow. If a component of a lamp is bent out of shape, the lampshade may not be level to a table or floor. Thus, it is desirable to limit the effects on lamp components when subjected to a force, and to allow for a lampshade to automatically adjust to being level if the lamp components are bent.

SUMMARY OF THE INVENTION

Systems and methods involving leveling lampshades are provided. In this regard, an exemplary embodiment comprises a system for leveling a lampshade comprising, a pivot member operative to engage a post of a lamp harp and support a spyder portion of a lampshade, and a retaining member operative to engage the post and induce a force on the spyder portion.

An embodiment comprises a lamp comprising, a harp having a post, a pivot member engaging the harp operative to support a spyder portion of a lampshade, and a retaining member operative to engage the post and exert a force on the spyder portion.

A method of assembling a lampshade leveling system, the method comprising, placing a spyder portion of a lampshade on a pivot member, placing a damper in a cavity of the spyder portion, threading a retaining member onto a post of a lamp harp.

Other systems, methods, features, and/or advantages of the present invention will be or may become apparent to one with skill in the art upon examination of the following drawings and detailed description. It is intended that all such additional systems, methods, features and/or advantages be included within this description and protected by the accompanying claims.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter that is regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

Figure 1B:
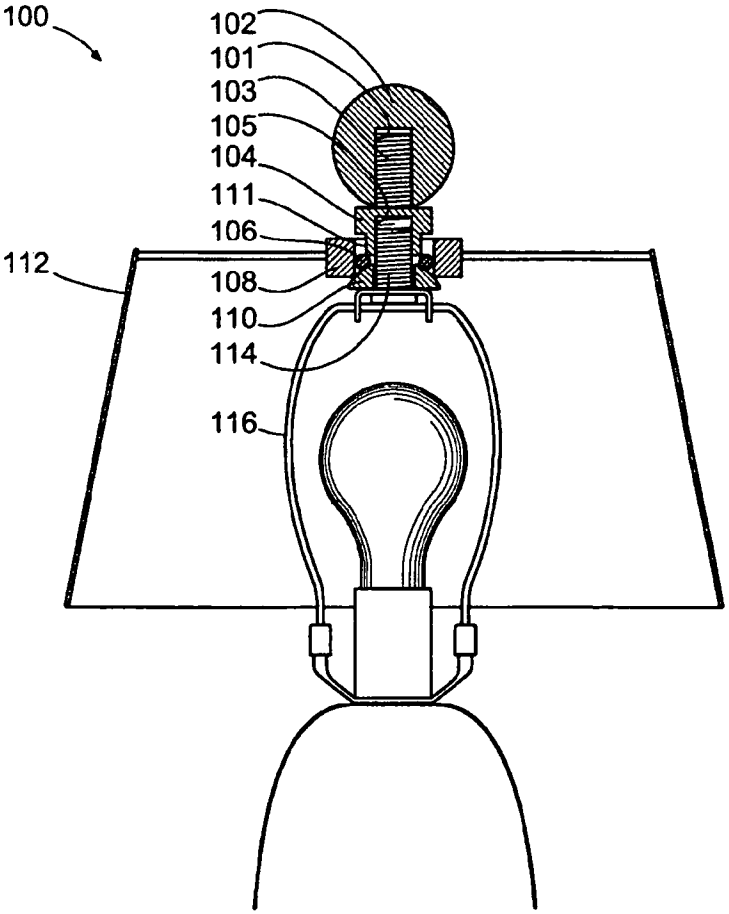
FIGS. 1*a* and 1*b* are side partially cutaway views illustrating an exemplary embodiment of a lampshade leveling system.

The detailed description explains the preferred embodiments of the invention, together with advantages and features, by way of example with reference to the drawings.

DETAILED DESCRIPTION OF THE INVENTION

Systems and methods involving leveling lampshades are provided. Referring now in detail to the drawings, FIG. 1*a* is a side partially cutaway view illustrating an exemplary embodiment of a lampshade leveling system 100.

The lampshade leveling system 100 comprises a finial 102, a retaining member 104, a damper 106, a spyder 108, a pivot member 110, a lampshade 112, a post 114, and a harp 116.

Figure 1A:
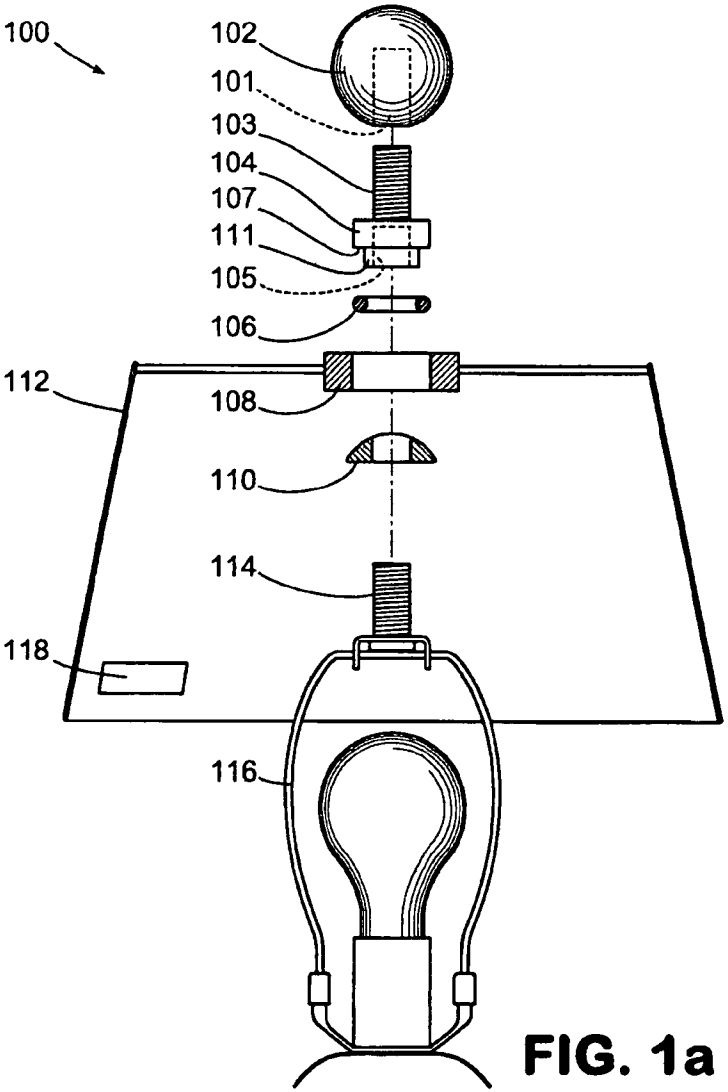

FIG. 1*b* is a side partially cutaway view illustrating the assembled lampshade leveling system 100. The lampshade leveling system 100 is assembled by placing the pivot member 110 over the post 114 that is connected to the harp 116. The pivot member 110 has a cavity that is a diameter that is greater than the diameter of the post 114. The post 114 engages the cavity and extends through the pivot 110 member such that threads of the post 114 are exposed. The pivot member has an outer profile that is curved.

The lampshade 112 is placed on the post 114 by placing a center cavity of the spyder 108 over the post 114. A bottom surface of the spyder 108 rests on the curved profile of the pivot member 110. In the illustrated embodiment, the damper 106 is placed over the post 114 and rests on the curved profile of the pivot member and in the center cavity of the spyder 108. The damper 106 in the illustrated embodiment is an O-ring, however other types of elastic or malleable dampers may be used, including multiple dampers 106. The embodiment is not limited to O-rings and may include any suitable damping material. Alternate embodiments may not include a damper 106.

The retaining member 104 has a cavity 105 that may be threaded and engages threads of the post 114. A bottom surface of the retaining member 104 contacts the damper 106. The finial 102 may be attached to a threaded post 103 of the retaining member 104 and engages the threaded portion threaded post 103 with a threaded cavity 101. The retaining member 104 may include a flange portion 107 having an outer diameter.

In operation, when a force is implied on the lampshade 112, the spyder 108 pivots on the pivot member 110. The pivot member 110 may remain substantially stationary relative to the motion of the spyder 108. The post 114 and the harp 116 also may remain stationary. Thus, the spyder 108 pivots relative to the post 114 and the harp 116. The force of gravity eventually returns the lampshade 112 to a position level with a table or floor.

The retaining member 104 exerts a compressive force on the damper 106. The compressive force on the damper 106 may be adjusted by rotating the retaining member 104 on the post 114. By tightening the retaining member 104 onto the post 114, the compressive force exerted on the damper 106 is increased. The compressive force may act to expand the damper 106 radially from the post 114. As the damper 106 expands, the effects of the damper 106 on the motion of the spyder 108 is increased. Thus, by tightening the retaining member 104, the range of motion of the spyder 108 and the lampshade 112 may be controlled. Additionally, the amount of force necessary to pivot the spyder 108 increases with the tightening of the retaining member 104.

The retaining member 104 includes a flange portion 107. The flange portion 107 increases the range of motion of the spyder 108. The flange portion 108 effectively reduces the diameter of the retaining member 104 in the cavity of the spyder 108 allowing greater clearance when the spyder 108 pivots.

The illustrated exemplary embodiment, the lampshade 112 includes a weight 118 that may be adjusted by a user to ensure that the lampshade 112 is balanced. Preferably, the balanced lampshade will return to a position level with a table or floor following a bump from a user. The weight 118 may be magnetic so that it attaches magnetically to the lampshade 112. Alternatively, the weight 118 may be secured to the lampshade 112 with an adhesive, or another securing means such as Velcro. In another exemplary embodiment, the lampshade 112 may be balanced in or after production to ensure that the lampshade 112 returns to a level position.

The lampshade leveling system 100 also has the advantage of allowing the lampshade 112 to be level even if the harp 116 or other components of a lamp are misaligned, misformed, or deformed.

Figure 2B:
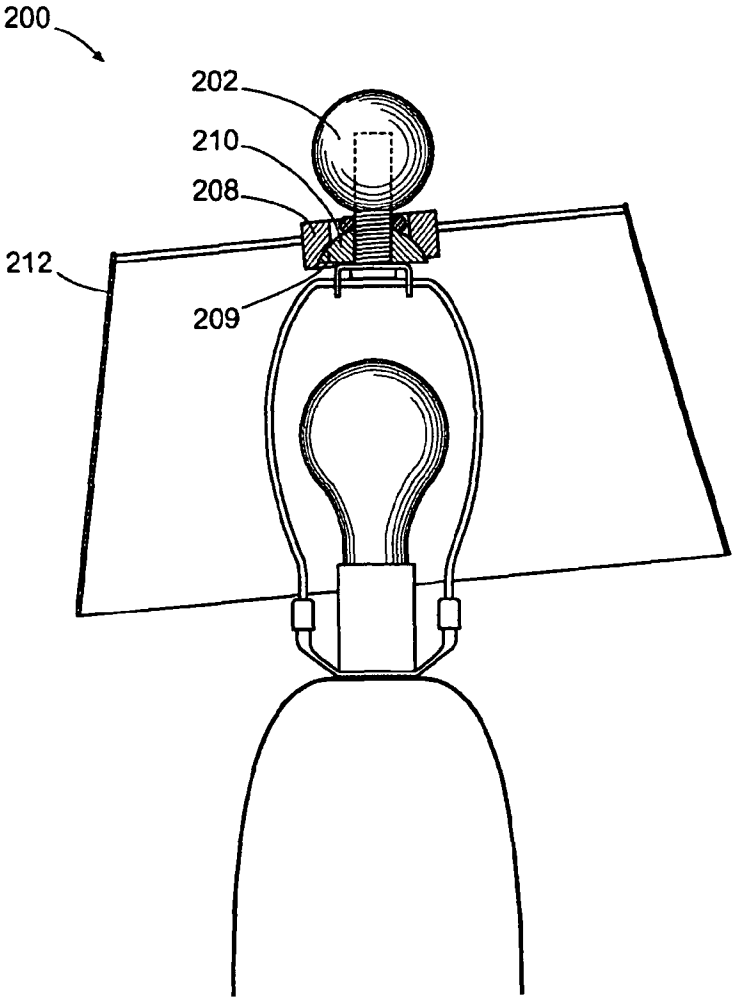
FIGS. 2*a* and 2*b* are side partially cutaway views illustrating an alternate exemplary embodiment of a lampshade leveling system.
Figure 2A:
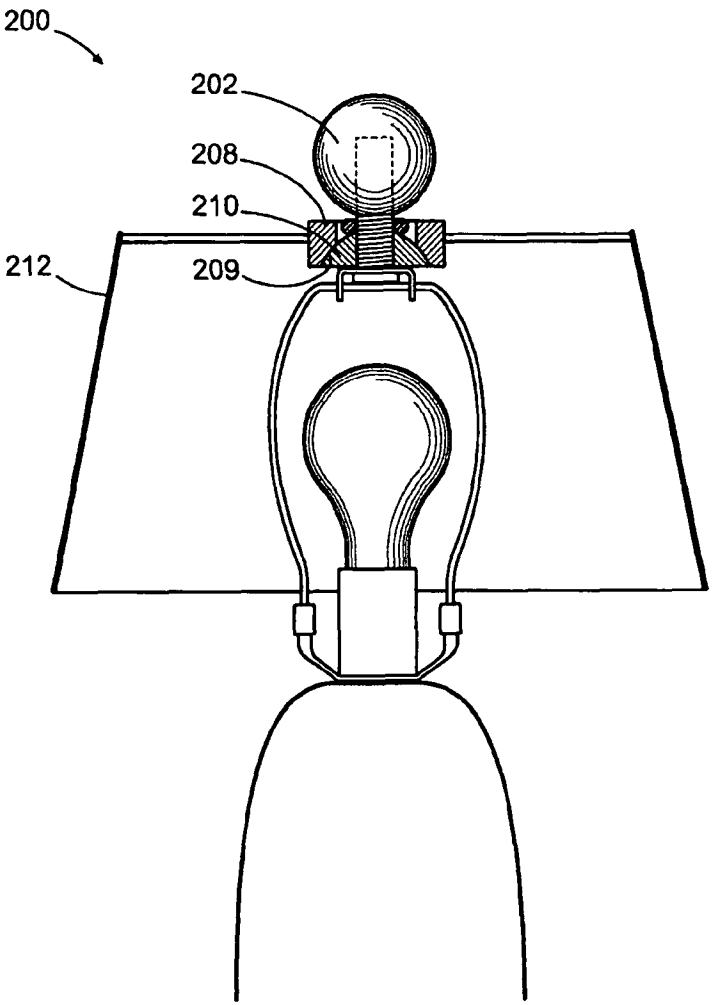

FIG. 2*a* illustrates a side partially cutaway view of an alternate exemplary embodiment of a lampshade leveling system. In the illustrated embodiment, lampshade leveling system 200 includes a spyder 208 that has a shaped interior surface 209. In this embodiment, the shaped interior surface 209 is curved such that it has a profile that engages the pivot member 210. This embodiment is but one example of the shaped interior surface 209. The shaped interior surface 209 may be, but is not limited to a beveled shape, or another curved shape that facilitates the pivoting of the lampshade 212. The reduced profile of spyder 208 may allow for a finial 202 to act as a retaining member. FIG. 2*b* illustrates a side partially cutaway view of an alternate exemplary embodiment of a lampshade leveling system 200 where the lampshade 212 is angled.

Figure 3B:
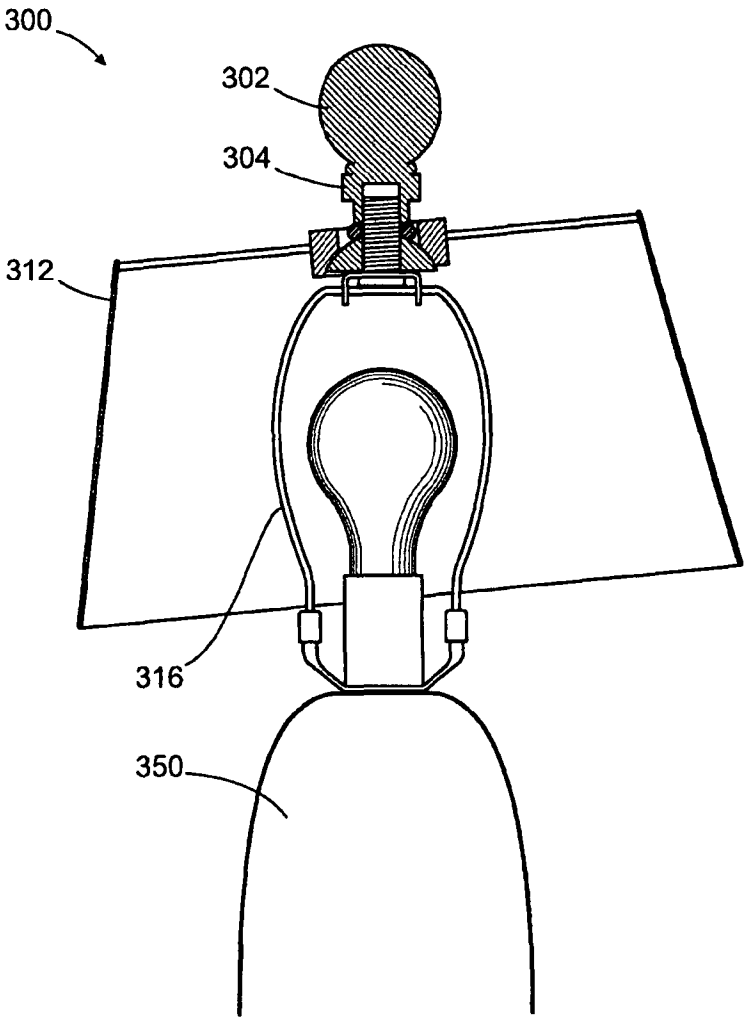
FIGS. 3*a* and 3*b* are side partially cutaway views illustrating another alternate exemplary embodiment of a lamp and a lampshade leveling system.
Figure 3A:
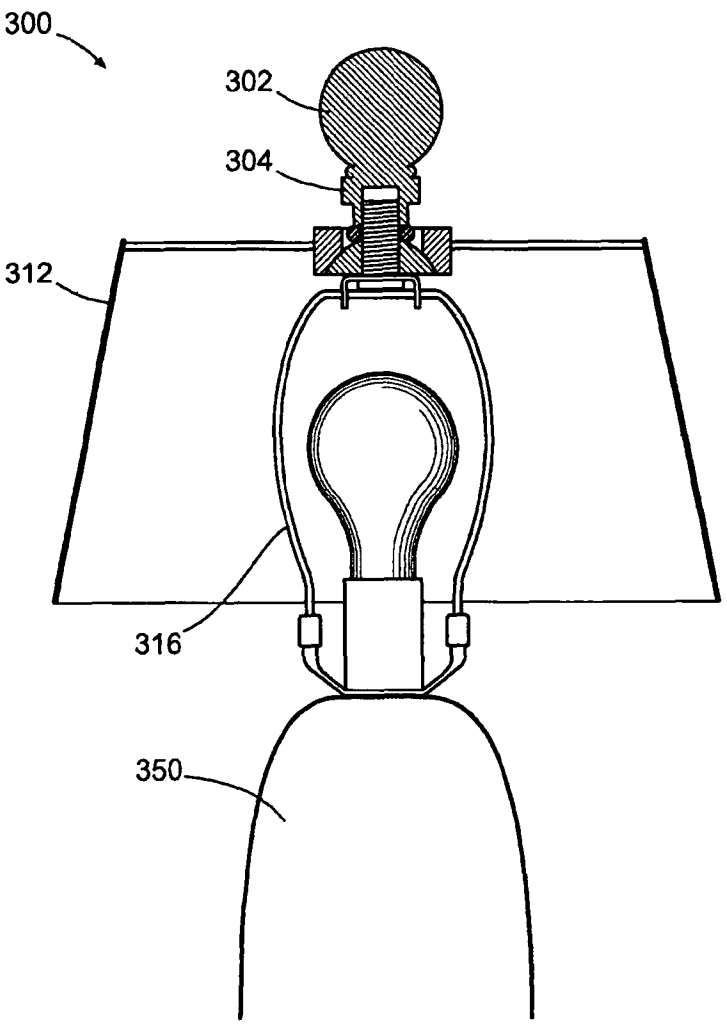

FIG. 3*a* illustrates a side partially cutaway view of an alternate exemplary embodiment of a lampshade leveling system. In the illustrated embodiment, lampshade leveling system 300 includes a retaining member 304 having an incorporated finial portion 302, and a lamp 350 connected to a harp 316. The incorporated finial portion 302 allows a simplified design without using a threaded portion to attach a separate finial 102 (as shown in FIG. 1*a*). FIG. 3*b* illustrates a side partially cutaway view of an alternate exemplary embodiment of a lampshade leveling system 300 where the lampshade 312 is angled.

Figure 4:
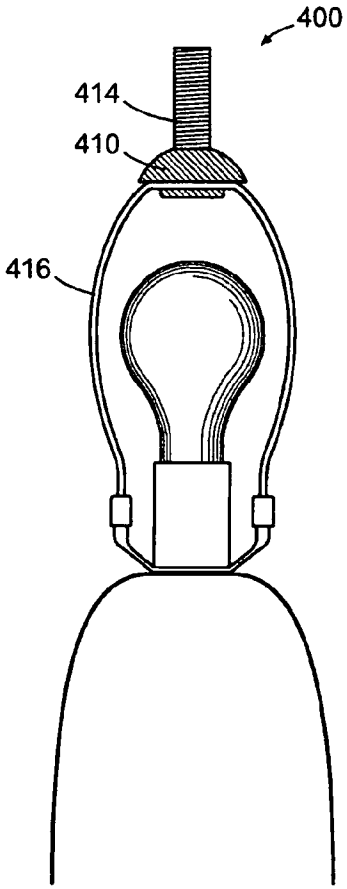
FIG. 4 is a side view illustrating an exemplary embodiment of an alternate embodiment of a harp of a lampshade leveling system.

FIG. 4 illustrates an alternate partially cutaway view of an exemplary embodiment of a lampshade leveling system. In the illustrated embodiment, lampshade leveling system 400 includes a pivot member 410 that is attached to a harp 416. A threaded post 414 is connected to the pivot member 410. The lampshade leveling system 400 reduces the number of separate components used in assembling the system 400, and operates in a similar manner as the embodiments described above.

Figure 5B:
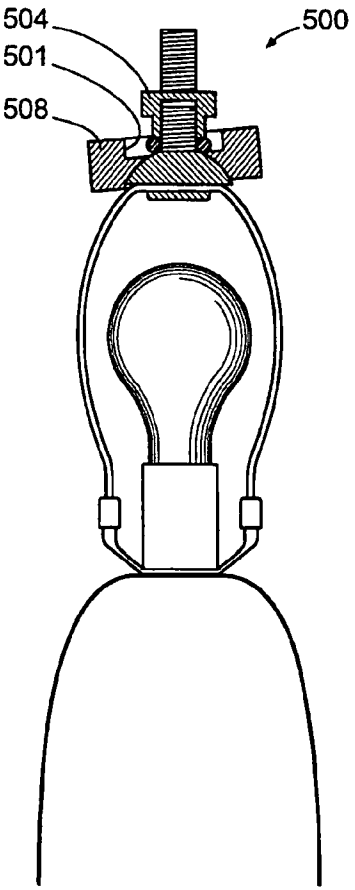
FIGS. 5*a* and 5*b* are side partially cutaway views illustrating of another alternate exemplary embodiment of a lampshade leveling system.
Figure 5A:
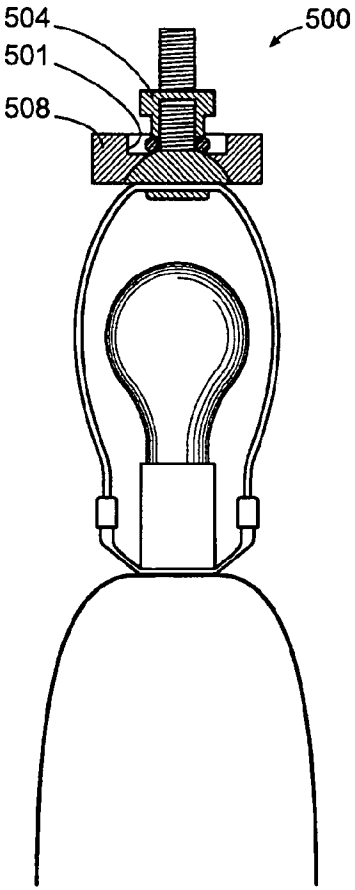

FIGS. 5*a* and 5*b* include a partially cutaway view of an alternate exemplary embodiment of a lampshade leveling system. In the illustrated embodiment, lampshade leveling system 500 includes a spyder 508 having a reduced vertical profile. The vertical profile of the spyder 508 is reduced by incorporating a cavity 510 in the upper surface of the spyder 508.

While the preferred embodiment to the invention has been described, it will be understood that those skilled in the art, both now and in the future, may make various improvements and enhancements which fall within the scope of the claims that follow. These claims should be construed to maintain the proper protection for the invention first described.

What is claimed is:

1. A system for leveling a lampshade comprising:

a pivot member defining an orifice operative to engage a post of a lamp harp and support a spyder portion of the lampshade, wherein the post of the lamp harp extends through the orifice of the pivot member and through the spyder portion of the lampshade while engaged with the pivot member; and a retaining member having a threaded cavity operative to engage the post of the lamp harp, the retaining member operative to induce a force on the spyder portion, the retaining member including a post member having a threaded outer surface with a substantially similar diameter as an outer diameter of the post of the lamp harp.

2. The system of claim 1, wherein the system further comprises a damper operative to dampen a motion of the spyder portion relative to the post.

3. The system of claim 2, wherein the retaining member is operative to induce a compressive force on the damper.

4. The system of claim 1, wherein the pivot member includes a curved surface operative to support the spyder portion.

5. The system of claim 1, wherein the system further includes a weight member operative to balance the lampshade such that the lampshade rests level relative to a reference plane.

6. The system of claim 1, wherein the system further includes a damper having a cavity operative to engage the post.

7. The system of claim 1, wherein the post member is operative to engage a finial.

8. A lamp comprising:

a harp having a post;

a pivot member defining an orifice engaging the post of the harp operative to support a spyder portion of a lampshade, wherein the post of the harp extends through the orifice of the pivot member and through the spyder portion of the lampsade; and a retaining member having a threaded cavity operative to engage the post of the lamp harp, the retaining member operative to exert a force on the spyder portion, the retaining member including a post member having a threaded outer surface with a substantially similar diameter as the post of the harp.

9. The lamp of claim 8, wherein the lamp further comprises a damper operative to dampen a motion of the spyder portion relative to the post.

10. The lamp of claim 9, wherein the retaining member is operative to induce a compressive force on the damper.

11. The lamp of claim 8, wherein the pivot member includes a curved surface operative to support the spyder portion.

12. The lamp of claim 8, wherein the lamp further includes a weight member operative to balance the lampshade such that the lampshade rests level relative to a reference plane.

13. The lamp of claim 8, wherein the lamp further includes a damper having a cavity operative to engage the post.

14. The lamp of claim 8, wherein the post member is operative to engage a finial.

15. A method of assembling a lampshade leveling system, the method comprising:

placing a sypder portion of a lampshade on a pivot member;

placing a damper in a cavity of the sypder portion;

threading a retaining member onto a post of a lamp harp; and balancing the lampshade by placing a weight member on the lampshade.

16. The method of claim 15, wherein the retaining member induces a compressive force on the damper.

* * * * *